US012741723B2

(12) United States Patent
Huseklepp

(10) Patent No.: US 12,741,723 B2
(45) Date of Patent: Sep. 22, 2026

(54) GYRO STABILIZER

(71) Applicant: SLEIPNER MOTOR AS, Fredrikstad (NO)

(72) Inventor: Kjetil Huseklepp, Oslo (NO)

(73) Assignee: SLEIPNER MOTOR AS, Fredrikstad (NO)

( * ) Notice: Subject to any disclaimer, the term of this patent is extended or adjusted under 35 U.S.C. 154(b) by 289 days.

(21) Appl. No.: 18/705,311

(22) PCT Filed: Oct. 27, 2022

(86) PCT No.: PCT/NO2022/050246

§ 371 (c)(1),
(2) Date: Apr. 26, 2024

(87) PCT Pub. No.: WO2023/075607

PCT Pub. Date: May 4, 2023

(65) Prior Publication Data

US 2025/0223014 A1 Jul. 10, 2025

(30) Foreign Application Priority Data

Oct. 28, 2021 (NO) ..... 20211291

(51) Int. Cl.
*B63B 39/04* (2006.01)

(52) U.S. Cl.
CPC ..... *B63B 39/04* (2013.01)

(58) Field of Classification Search
CPC ..... B63B 39/04
See application file for complete search history.

(56) References Cited

U.S. PATENT DOCUMENTS

| | | | | |
|---|---|---|---|---|
| 3,845,995 | A * | 11/1974 | Wehde | H02K 29/06 310/156.05 |
| 3,888,553 | A | 6/1975 | Wehde | |
| 2005/0076726 | A1 | 4/2005 | Akers | |
| 2005/0274210 | A1 | 12/2005 | Adams et al. | |

FOREIGN PATENT DOCUMENTS

| | | | |
|---|---|---|---|
| CN | 102381452 | A | 3/2012 |
| CN | 105292395 | A | 2/2016 |
| IT | TO20110955 | A1 | 4/2013 |
| WO | WO 2007/095403 | A2 | 8/2007 |
| WO | WO 2009/052549 | A1 | 4/2009 |
| WO | WO 2021/080437 | A1 | 4/2021 |
| WO | WO 2021/174315 | A1 | 9/2021 |

OTHER PUBLICATIONS

International Search Report, issued in PCT/No. 2022/050246, PCT/ISA/210, dated Feb. 17, 2023.
Written Opinion of the International Searching Authority, issued in PCT/No. 2022/050246, PCT/ISA/237, dated Feb. 17, 2023.

* cited by examiner

*Primary Examiner* — Stephen P Avila
(74) *Attorney, Agent, or Firm* — Birch, Stewart, Kolasch & Birch, LLP

(57) ABSTRACT

A gyro stabilizer includes a stator, a rotor with a rotor axle configured to rotate about a spin axis in a first direction, and a rotor base arranged between the stator and the rotor. The rotor base is configured to allow the rotor axle to move with regards to the stator a direction different from the first direction.

15 Claims, 6 Drawing Sheets

GYRO STABILIZER

TECHNICAL FIELD

The present invention relates to technology for stabilizing boats and ships. More specifically, the invention relates to a gyroscopic stabilizer that can be used to counteract roll or pitch motion.

BACKGROUND

Prior art gyro stabilizers for vessels work according to the well-established principle of stabilizing roll motion of the boat or vessel by making use of counteracting torque from a gyro stabilizer with a flywheel, or rotor, spinning in a gimbal structure.

When the gyro stabilizer is arranged in the vessel or boat, it is oriented with orthogonal flywheel spin axis, gimbal axis and vessel roll axis, where the vessel roll axis is in the longitudinal direction of the vessel. The angular momentum of the spinning flywheel is a conserved physical quantity, and when the boat rolls, the flywheel will precess to maintain the position of the boat. The precession will create a stabilizing torque counteracting the rolling torque on the hull, such that the gyro stabilizer will tend to right the boat.

During precession, i.e. when the gyro is precessing to counteract roll, the flywheel angle will vary with respect to the hull, resulting in torque components in the yaw and/or pitch directions. However, the vessel is in general resistant to both pitch and yaw rotation, but roll stabilizing efficiency is reduced with increased flywheel angle, since complementary forces increase.

An example of such a gyroscopic roll stabilizer is presented in US20050076726A1 and US2005274210 A1. The stabilizer includes a flywheel or a rotor, a flywheel drive motor configured to spin the flywheel about a spin axis, a gimbal structure configured to permit flywheel precession about a gimbal axis, and a device for applying a torque to the flywheel about the gimbal axis. The flywheel and gimbal structure are configured so that when installed in the boat the stabilizer damps roll motion of the boat. An electric motor connected to a spin axle accelerates the rotor up to a desired rotational speed. The flywheel may be mounted in an evacuated chamber to reduce air drag. The first reference indicates that the rotor may spin at a rate of 10000 rpm or higher.

However, as acknowledged in WO2007095403 A2, the heavy flywheel operating at high rotational speed is supported by bearings that are subjected to high axial and radial loads. As a result, these bearings produce a substantial amount of friction-generated heat, which must be dissipated in order to avoid dangerous heat build-up.

CN 102381452A shows a gyro stabilizer for a boat where a mechanical gear is used when spinning the rotor up to high speed, in order to reduce the size of the stabilizer.

As a result, high rotational speed is related to high abrasion of bearings and reduced lifetime. It is therefore difficult to increase rotational speed further, and gyros must be made large to keep rotational speed low and at the same time achieve sufficiently large gyroscopic precession.

U.S. Pat. No. 3,888,553 discloses a levitating magnetic device, where a rotor is magnetically supported. However, this type of solution is not well adapted to handle large torque as a result of roll movements in a boat, and to provide an opposite directed torque to stabilize the boat.

WO 2021080437 A1 discloses a gyro stabilizer for a vessel the where the rotor assembly is arranged radially outside the stator assembly with respect to the spin axis and the rotor and/or stator assemblies comprises magnets with magnetic axis in the direction of the spin axis.

CN105292395A discloses a gyrostabilizer for a ship and a stabilizing gyrorotor system. A rotor frame of the stabilizing gyrorotor system is connected with a base bearing through a precession axle; and the base is fixedly connected on a ship body structure. When a ship body transversely rolls, the base transversely rolls together with the ship body.

WO2021174315A1 describes a gyrostabiliser assembly (1) for a marine vessel comprising: a housing (2) defining a chamber (3) for supporting at least a partial vacuum; a flywheel (4) mounted within the chamber (3) for rotation about a spin axis (Z) at the partial vacuum; a flywheel shaft (5) upon which the flywheel (4) is supported and mounted in the housing for rotation of the flywheel about the spin axis (Z), the flywheel shaft being rotatably supported by a first spin bearing (6) located at one end region of the shaft (5) and a second spin bearing (7) located at an opposite end region of the shaft (5).

ITTO20110955A1 discloses a gyroscopic stabilizer for stabilizing a vessel in which the rotating mass is reduced in order to reduce load on the bearings.

To achieve the desired stabilizing effect with a more compact gyrostabilizer, the flywheel should preferably have a large part of its mass located along its circumference, or rim. Thus, the flywheel, or the rotor has a large angular momentum and relatively large mass that affects the rotor bearings considerably as soon as an external force tries to bring the rotor out of equilibrium. While the bearings may be dimensioned for handling roll and pitch motions of a vessel, they may not always handle more direct impacts resulting from e.g., the vessel accidentally hitting an obstacle. This problem is related to all types of gyro stabilizers, and may be of specific relevance for relatively low cost gyro stabilizers for boats with smaller hulls, where the crew may be less trained and there is less resources for customization of the stabilizers.

Further, the operational dynamics of magnetic gyros according to prior art may require improvement, e.g., to reduce noise, vibrations and energy consumption. At the same time there is a need to reduce production costs.

SHORT SUMMARY

A goal with the present invention is to overcome the problems of prior art, and to disclose an improved gyrostabilizer.

The invention solving the above-mentioned problems is a gyro stabilizer according to the independent claims.

The following technical effects may be obtained by the gyro stabilizer according to embodiments of the invention;

The lifetime of the gyro stabilizer may be improved.

The damages on the vessel resulting from an unintentional impact and high transient loads may be reduced. I.e., such damages may be the related to the fixture of the gyro stabilizer in the vessel, and the impact a sudden force on the gyro stabilizer elements may have on the other parts of the vessel.

The gyro stabilizer may be more silent and generate less vibrations than prior art stabilizers.

The gyro stabilizer may be made more compact than prior art stabilizers, since the rotational speed of the rotor can increase without increasing abrasion and reducing lifetime of ball bearings.

Since the gyro stabilizer can rotate with higher rotational speed, the rotor diameter may be reduced, and less torque is required to start spinning the rotor.

The gyro stabilizer may have a higher reliability and energy efficiency than prior art gyro stabilizers.

Consequently, there may be a reduced cost of operation.

The gyro stabilizer is oil free and therefore cleaner and more environmentally friendly than gyro stabilizers with an oil sump.

Due to its design it may be easily sealed to operate in vacuum or gas filled space.

EMBODIMENTS OF THE INVENTION

Figure 1:
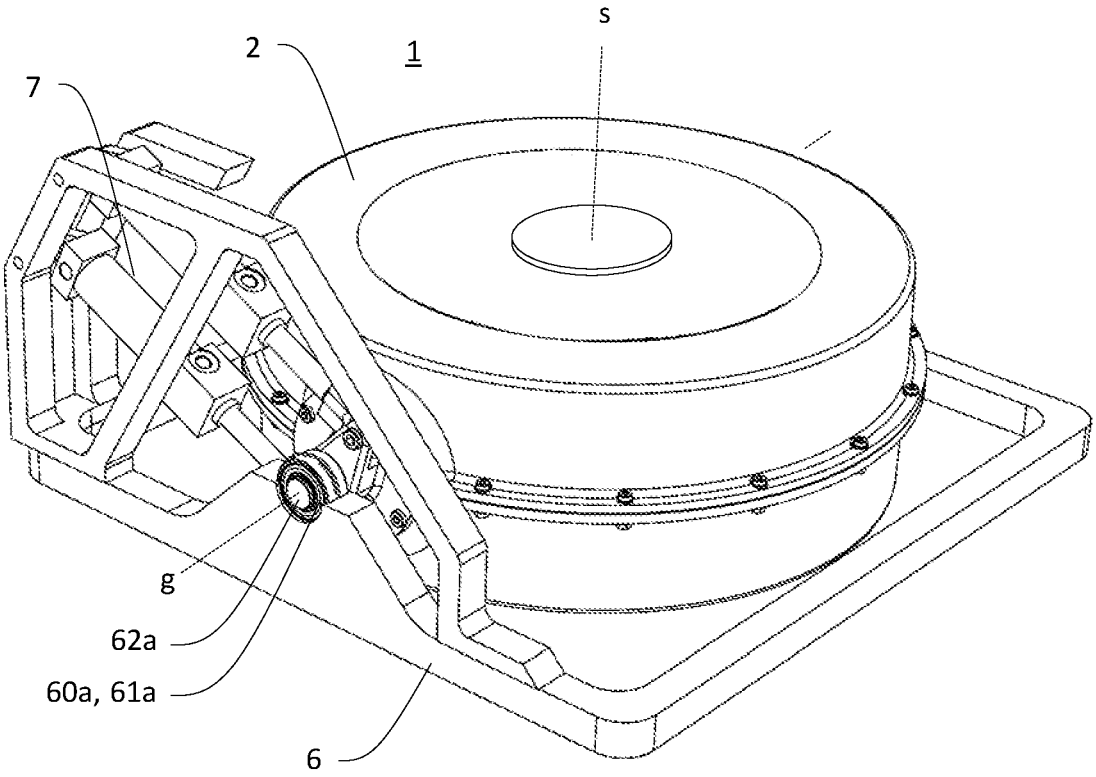
FIG. 1 illustrates in a perspective view an embodiment of a gyro stabilizer 1 according to the invention.

In the following description, various examples and embodiments of the invention are set forth in order to provide the skilled person with a more thorough understanding of the invention. The specific details described in the context of the various embodiments and with reference to the attached drawings are not intended to be construed as limitations. Rather, the scope of the invention is defined in the appended claims.

The embodiments described below are numbered. In addition, dependent embodiments defined in relation to the numbered embodiments are described. Unless otherwise specified, any embodiment that can be combined with one or more numbered embodiments may also be combined directly with any of the dependent embodiments of the numbered embodiments referred to.

In a first embodiment EG1 the invention is a gyro stabilizer 1 comprising;

a stator 2, a rotor 3 with a rotor axle 36 configured to rotate about a spin axis s in a first direction, and a rotor base 4, 40 arranged between the stator 2 and the rotor 3, wherein the rotor base 4, 40 is configured to allow the rotor axle 36 to move with regards to the stator 2.

Due to the rotor base 4, 40, the rotor axle 36 may move in a direction different from the first direction, where the first direction is the rotation about the spin axis s.

In a first dependent embodiment, the rotor base 4, 40 is configured to allow a first end 36*a* of the rotor axle 36 to move laterally with respect to the stator 2.

In a second dependent embodiment, that may be combined with the first dependent embodiment, the rotor base 4, 40 is configured to allow first end 36*a* of the rotor axle 36 to move axially with respect to the stator 2.

In a third dependent embodiment, that may be combined with the first or second dependent embodiment, the rotor base 4, 40 is configured to allow the rotor axle 36 to pivot with respect to the stator 2.

In a fourth dependent embodiment, that may be combined with any of the first to third dependent embodiment, the rotor base 4, 40 is configured to allow the rotor axle 36 to move and pivot in three dimensions with regards to the stator 2.

In an embodiment EG2, that may be combined with EG1, the first end 36*a* is supported by a first rotational bearing 35*a* fixed to the rotor axle 36, wherein the rotor base 4, 40 comprises a compressible elastic element 42, 47 arranged compressed in lateral and longitudinal directions with respect to the rotor axle 36 between the stator 2 and the first rotational bearing 35*a*.

In a first dependent embodiment, the elastic element 42, 47 is at least partly made in a plastic material.

In an embodiment EG3, that may be combined with EG2, the rotor base 4, 40 comprises a first compression element 43 configured to compress the elastic element 42, 47.

In a first dependent embodiment, the first compression element 43 is a compressible spring 43 configured to act with a constant force on elastic element 42, 47.

In a second dependent embodiment, that may be combined with the first dependent embodiment, the compressible spring is a disc spring.

In a third dependent embodiment, that may be combined with the first or second dependent embodiment, the rotor base 4, 40 comprises a first spring end support 46 configured to compress the spring 9 when mounted to the stator 2.

In a fourth dependent embodiment, that may be combined with any of the first to third dependent embodiment, the rotor base 4, 40 comprises a first force distribution element 44 arranged between the first compression element 43 and the elastic element 42, configured to distribute the force from the first compression element 43 over at least a part of a surface of the elastic element 42.

In an embodiment EG2, that may be combined with any of EG1 to EG3, the rotor axle 36 is supported by a first rotational bearing 35*a* fixed to the rotor axle 36, and the rotor base 40 comprises a first frictional interface 45 between the first rotational bearing 35*b* and the stator 2, wherein the frictional interface allows the rotor axle 36 to pivot with respect to the stator 2.

In a first dependent embodiment, the frictional interface 45 has the shape of a spherical segment, allowing the rotor axle 36 to pivot in any direction with regards to the stator 2.

In a second dependent embodiment, that may be combined with the first dependent embodiment, the first frictional interface (45) is arranged at least partly within 35 degrees from a plane perpendicular to the spin axis(s) and in height with the gimbal axis (g).

In an embodiment EG5, that may be combined with EG 4, the rotor base 4 comprises first inner and outer coupling elements 41, 42, wherein the first inner coupling element 41 is fixed to the first bearing 35*a* and the first outer coupling element 42 is fixed to the stator 2, wherein an interface between the first inner and outer coupling elements 41, 42 is the first frictional interface.

In a first dependent embodiment, any of the first inner or outer coupling elements 41, 42 are compressible and elastic.

In a second dependent embodiment, that may be combined with the first dependent embodiment, any of the first inner or outer coupling elements 41, 42 is more elastic and compressible than the other.

In a third dependent embodiment, that may be combined with the first or second dependent embodiment, any of the first inner or outer coupling elements are made in plastic material.

In a fourth dependent embodiment, that may be combined with any of the first to third dependent embodiment, the outer coupling element 42 is the elastic element 47.

In a fifth dependent embodiment, that may be combined with any of the first to fourth dependent embodiment, the inner and outer coupling elements 41, 42 have interfacing convex and concave shapes, respectively.

In a sixth dependent embodiment, that may be combined with any of the first to fifth dependent embodiment, the inner coupling element 41 is configured to move relative the outer coupling element 42 only when a torque on the rotor 3 relative the stator 2 increases above a torque threshold.

In a seventh dependent embodiment, that may be combined with the sixth dependent embodiment, the torque threshold is determined by the force from the first spring end support 46 compressing the first compression element 43 that again is compressing the outer coupling element 42.

More force means more friction and a higher torque threshold.

In an embodiment EG6, that may be combined with any of the embodiments EG1 to EG5 above, the rotor axle 36 comprises a second end 36*b* with a second bearing 35*b* supported by the rotor base 4, 40, wherein the rotor base 4, 40 is symmetric about a plane perpendicular to the rotor axle 36, when the rotor axle 36 is not affected by external forces.

In a first dependent embodiment, the rotor 3 comprises a rotor disc 34 arranged extending from the rotor axle 36, wherein the rotor base 4, 40 is symmetric about the rotor disc 34.

In a second dependent embodiment, that may be combined with the first dependent embodiment, the frictional interfaces 45 supporting the first and second bearings 35*a*, 35*b* are both spherical with a common radius from an origin between the first and second bearings 35*a*, 35*b*.

In an embodiment EG7, that may be combined with any of the embodiments EG1 to EG 6 above, the gyro stabilizer is magnetic, and wherein the rotor 3 and the stator 2 comprise rotor and stator assemblies 31, 21, respectively, wherein the rotor assembly 31 is arranged radially outside the stator assembly 21 with respect to the spin axis s.

In a first dependent embodiment, any of the rotor and stator assembly comprises magnets 31*a*, 21*a* stacked with alternating magnetic field directions in the direction of the spin axis s.

The magnetic axis is the line joining the two poles of a magnet.

In a second dependent embodiment, that may be combined with the first dependent embodiment, the rotor/and or stator assembly magnets 31*a*, 21*a* are stacked with alternating magnetic field directions in the direction of the spin axis s.

In a third dependent embodiment, that may be combined with the first or second dependent embodiment, the rotor and/or stator assemblies 31, 21 comprises rotor and/or stator intermediate elements 31*b*, 21*b*, arranged between the rotor and/or stator magnets 31*a*, 21*a* respectively.

In a fourth dependent embodiment that may be combined with any of the dependent embodiments above, wherein both the rotor and stator assemblies 31, 21 comprises magnets, wherein magnets in the stator assembly 21 are vertically aligned with—and interfaces magnets in the rotor assembly 31 with opposite magnetic field directions.

In a fifth dependent embodiment, that may be combined with the third and fourth dependent embodiments, the rotor and stator assemblies 31, 21 comprise intermediate elements 31*b*, 21*b*, wherein the rotor intermediate elements 31*b* are vertically aligned with and interfaces corresponding stator intermediate elements 21*b*.

In a sixth dependent embodiment, that may be combined with any of the third to fifth dependent embodiments, the rotor intermediate elements 31*b* are arranged closer to the stator assembly 21 than the rotor magnets 31*a*.

In a seventh dependent embodiment, that may be combined with any of the third to sixth dependent embodiments, stator intermediate elements 21*b* are arranged closer to the rotor assembly 31 than the stator magnets 11*a*.

In an eight dependent embodiment, that may be combined with any of the third to seventh dependent embodiments, any of the rotor and/or stator intermediate elements 31*b*, 21*b* are made in ferromagnetic material.

The stator and/or rotor assembly 21, 31 may be ring shaped.

In an embodiment EG8, that may be combined with EG7, the stator and rotor assemblies 21, 31 interfaces each other and are configured to provide layered radial magnetic field lines with alternating directions between each other, wherein the layers are stacked in a direction perpendicular to the radial direction, i.e., the direction of the spin axis s.

In a first dependent embodiment, the rotor assembly 31 comprises a layered structure of rotor magnetic field producing elements 31*a* separated by rotor intermediate elements 31*b* in the direction perpendicular to the radial direction.

In a second dependent embodiment that may be combined with the first related embodiment, subsequent rotor magnetic field producing elements 31*a* have alternating magnetic field directions perpendicular to the radial direction.

In a third dependent embodiment that may be combined with the first or second related embodiment, the stator assembly 21 comprises a layered structure of stator magnetic field producing elements 21*a* separated by stator intermediate elements 21*b* in the direction perpendicular to the radial direction, wherein subsequent stator magnetic field producing elements 21*a* have alternating magnetic field directions perpendicular to the radial direction, and interfacing stator magnetic field producing elements 21*a* and rotor magnetic field producing elements 21*a*, both have magnetic fields perpendicular to the radial direction, but in opposite directions.

The rotor magnetic field producing elements 31*a* may be permanent magnets.

The rotor intermediate elements 31*b* may be made of steel.

Simulations have been performed, showing that the technical effect of magnetic support can be achieved with magnets only in the rotor assembly, only in the stator assembly or in both assemblies. The effect is considerably larger when there are magnets in both assemblies.

In an embodiment EG9, that may be combined with any of EG1 to EG8, the gyro stabilizer comprises a frame 6 configured to be fixed to a boat, wherein the stator 2 is configured to pivot about a gimbal axis g with respect to the frame 6, wherein the gimbal axis g is perpendicular to the spin axis s.

In a first related embodiment, the gyro stabilizer comprises first and second gimbal pivots 60*a*, 60*b* pivotally interconnecting the stator 2 and the frame 6, wherein the first and second gimbal pivots 60*a*, 60*b*, in a plane perpendicular to the spin axis s, are arranged outside the rotor 3 and the stator 2.

In a second related embodiment that may be combined with the first related embodiment, the frame 6 comprises gimbal bearings 61*a*, 61*b* configured to support gimbal shafts 62*a*, 62*b* extending radially outwards from an outer radius of the stator 2, wherein the gimbal shafts 62*a*, 62*b* are fixed to the stator 2.

In a third dependent embodiment, the gyro stabilizer comprises a spin motor configured to rotate the rotor 3 relative the stator 2. The spin motor comprises a motor stator member rotationally fixed to the stator 2 and a motor rotor member rotationally fixed to rotor 3. The spin motor may comprise a motor housing enclosing the spin motor and configured to transfer heat from the spin motor to the surroundings.

A motor shaft from the motor rotor may be co-axially connected to the rotor axle 36, with a flexible coupling, in any of the embodiments disclosed.

The rotor member may dissipate heat to the rotor 3.

The gyro stabilizer 1 comprises in a first dependent embodiment a brake 7 interconnecting the frame 6 and the stator 2.

The brake 7 may be an active brake 7 comprising an actuator.

The gyro stabilizer may in an embodiment comprise a housing 4 enclosing the stator and rotor magnetic assemblies 21, 31 in a gas filled or evacuated space. The spin motor 5, 105 may also be arranged inside the same housing.

An independent embodiment will now be explained with reference to the attached drawings.

Figure 4A:
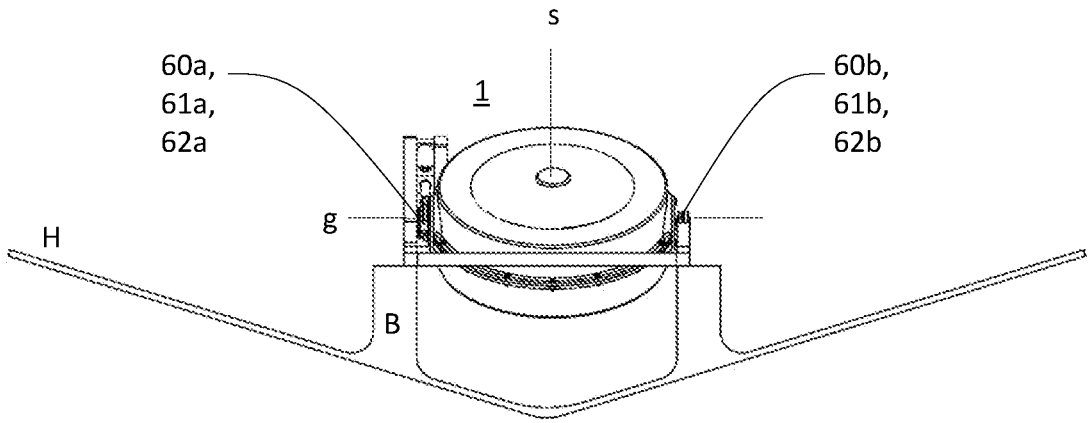
FIGS. 4*a* and 4*b* illustrate a section view of a hull H of a boat where the gyro stabilizer in FIG. 1 is arranged with the frame 6 resting on a bracket B or stringer in the centre of the hull.
Figure 4B:
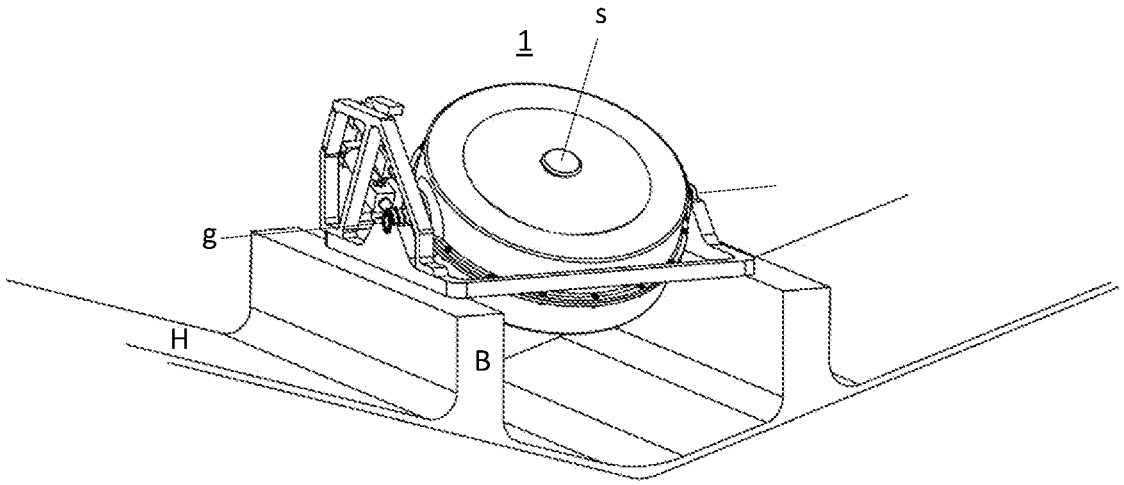

FIG. 1 illustrates in a perspective view an embodiment of a gyro stabilizer 1 according to the invention. The stator 2 is supported by the frame 6, and the rotor not visible is configured to rotate about the spin axis s inside the stator 2, wherein the stator 2 may pivot about the gimbal axis g to set up a stabilizing torque in the opposite direction of a motion of the frame in the plane constituted by the gimbal and spin axis g, s. In addition, FIG. 1, FIGS. 4*a* and 4*b* shows a gimbal pivot 60*a* interconnecting one side of the stator 2 and the frame 6. The gimbal pivot 60*a* comprises gimbal bearings 61*a* arranged in the frame 6, and gimbal shaft 62*a* extending radially outwards from an outer radius of the stator 2, wherein the gimbal shaft 62*a* is fixed to the stator 2 and supported by the gimbal bearing 61*a*. A clamp around the upper part of the gimbal pivot 60*a* and removably fixed to frame 6 has been intentionally left out for illustration purposes. The gyro stabilizer 1 has a respective gimbal pivot on the opposite side of the stator 2 which is not visible in the drawings. The gyro stabilizer 1 also comprises a brake 7 between the stator 2 and the frame 6 to control the gimbal angle and precession rate to optimize the stabilizing torque. In the present embodiment a hydraulic brake system connected to a control system is used.

Figure 2A:
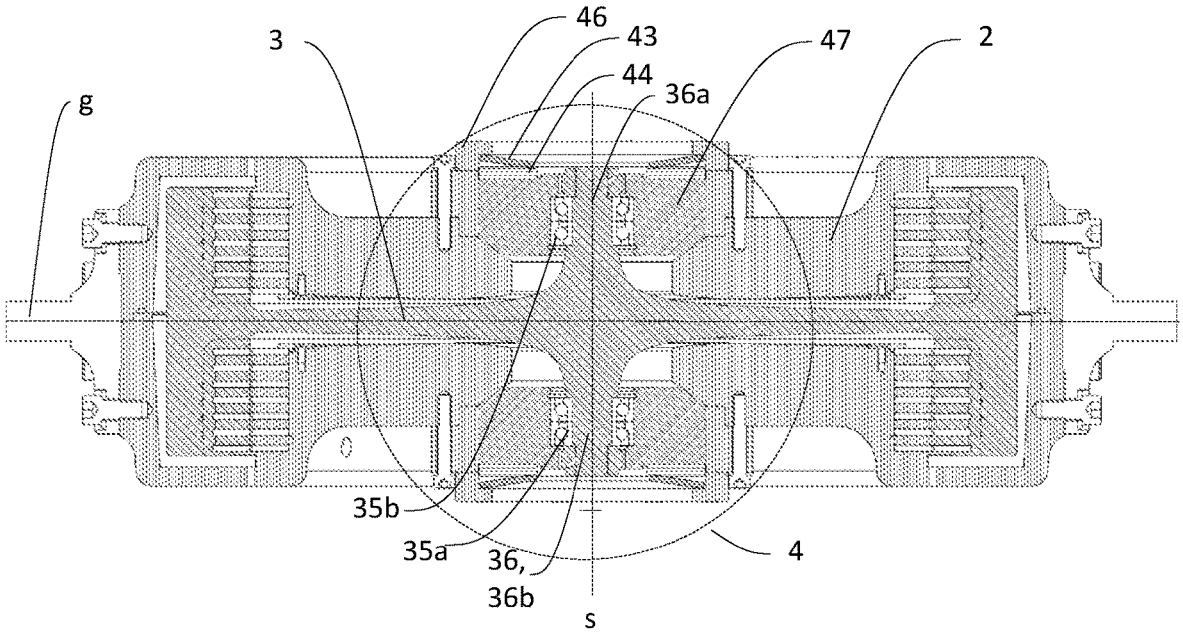
FIG. 2*a* illustrates in a section view an embodiment of the gyro stabilizer 1 in FIG. 1, where the cutting plane corresponds to the plane constituted by the spin and gimbal axis s, g.

FIG. 2*a* illustrates in a section view an embodiment of the gyro stabilizer 1 shown in FIG. 1, where the cutting plane corresponds to the plane constituted by the spin and gimbal axis s, g. As can be seen, the stator 2 provides a housing for the rotor 3.

The centre of the stator 2 comprises a rotor base 4 fixed to the stator and the rotor 3, wherein the rotor is suspended in the stator by means of the rotor base 4.

The rotor 3 is rotationally supported by the rotor base 0 in first and second ends 36*a*, 36*b* by first and second rotational bearings 35*a*, 35*b*, respectively. The rotor base is compressible and elastic and allows axial and lateral movement of the rotor axle 36 with regards to the stator 2. The rotor axle 36 may also pivot in any direction with regards to the stator 2, provided a torque on the rotor is sufficient to compress the elastic element 47 of the rotor base 40. This allows a magnetic gyro stabilizer to function properly. i.e., precess, since the rotor must be allowed to pivot up to a maximum angle with regards to the stator. Depending on the implementation, this angle may in the range 1.0+/−0.5 degree.

Thus, the rotor base in this embodiment, effectively absorbs external shocks and impacts on the stator. However, it may in certain situations also reduce harmonic noise and vibrations when the gyro is speeding up. The elastic rotor base has an effect for all types of gyro stabilizers, not only magnetic as in the illustration.

As seen in FIG. 2*a*, the rotor base 40 comprises a compressible elastic element 47 made in plastic material arranged compressed in lateral and longitudinal directions with respect to the rotor axle 36 between the stator 2 and the first rotational bearing 35*a*.

A first compression element 43 in the form of a disc spring is configured to compress the elastic element 47 with a constant force. The compression determines the elasticity and consequently the force needed to move the rotor relative to the stator.

A first compressible spring 43, in the form of a disc spring, is configured to act with a constant force on the elastic element 47. On the opposite side of the spring, a first spring end support 46 compresses the spring 9 when mounted to the stator 2.

The disc spring has a limited surface for interfacing the elastic element 47, and a first force distribution element 44, in this case an open disc, is arranged between the first compression element 43 and the elastic element 42, in order to distribute the force from the first compression element 43 over a larger surface of the elastic element 42.

Figure 2B:
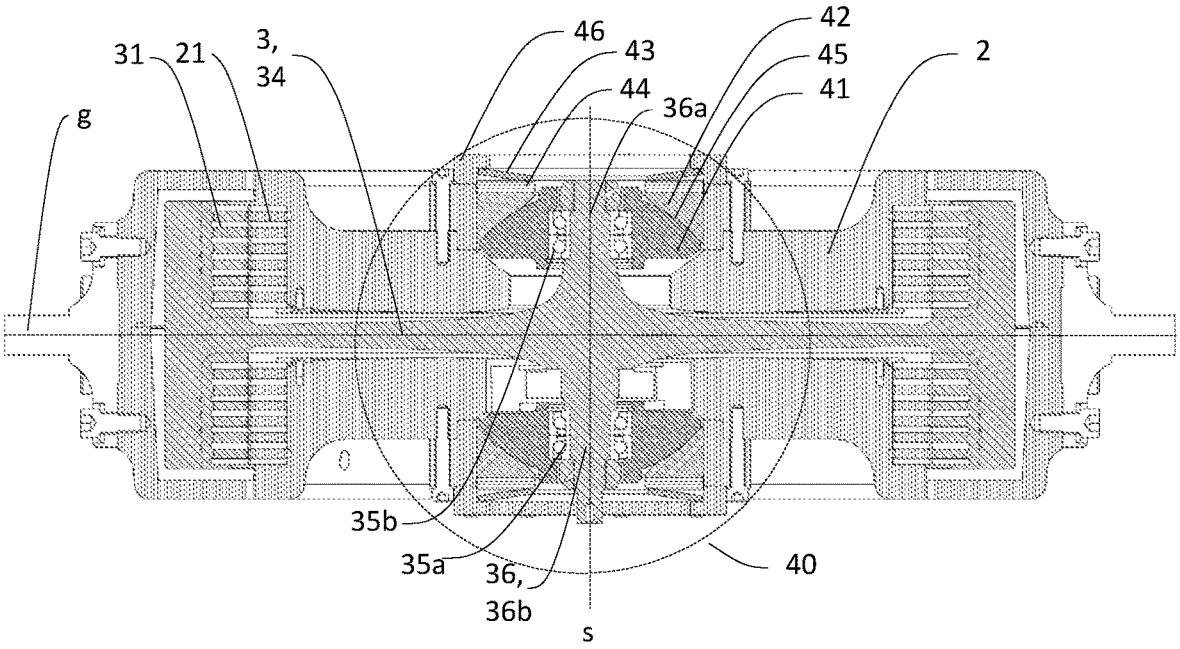
FIG. 2*b* illustrates in a section view an embodiment of the gyro stabilizer 1 in FIG. 1, where the cutting plane corresponds to the plane constituted by the spin and gimbal axis s, g.
Figure 2C:
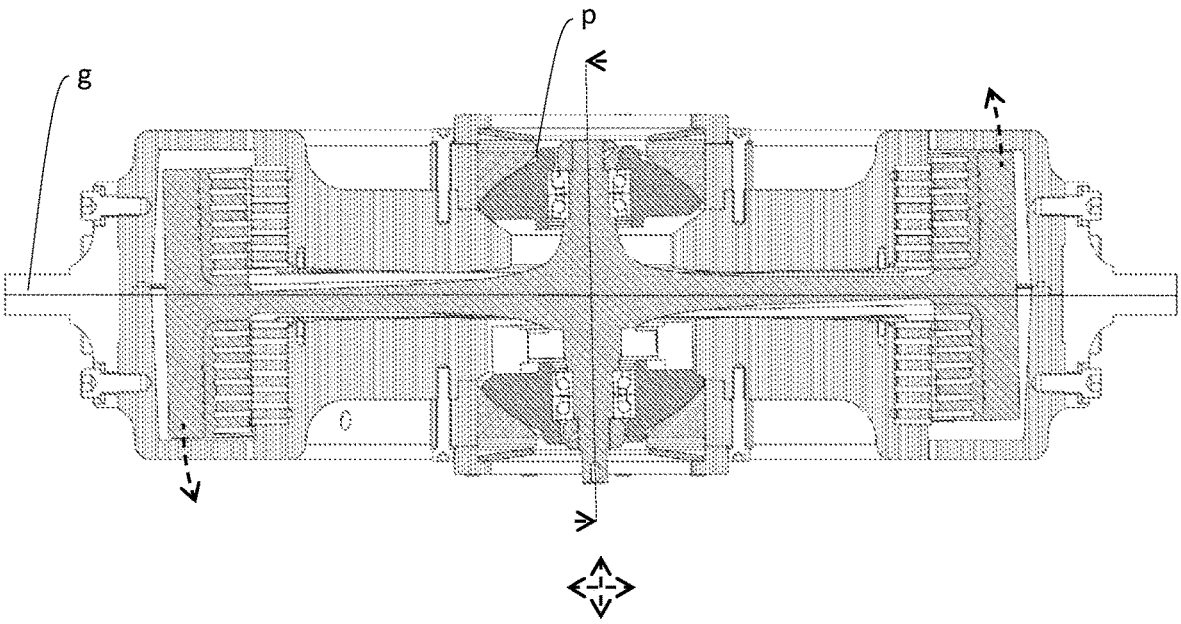
FIG. 2*c* is identical to FIG. 2*b*, illustrating the rotor 3 tilted to the left relative to the stator 2 as indicated by the arrows. The additional arrow cross illustrates how the rotor may move relative the stator as a result of external or internal impacts.

The rotor base 4 is symmetric about a plane perpendicular to the rotor axle 36 in the section view of FIGS. 2*b* and 2*c*, when the rotor axle 36 is not affected by external forces, or at standstill. The symmetry plane is further determined by the gimbal axis g.

The rotor 3 comprises, in addition to the rotor axle 36, a rotor disc 34 interconnecting the rotor axle 36 and a rotor assembly 31. The rotor comprising the rotor axle 36, the rotor disc 34 and a radial support for the rotor assembly 31 may be made in forged metal, such as aluminum.

A stator assembly 21 is fixed to the stator 2. The disc and the rotor and stator assemblies are also symmetric about the symmetry plane. Further details about the assemblies can found below and in FIGS. 3*a* and 3*b*.

A spin motor, not shown, is located below the second end 36*b* of the rotor axle 36 and configured to spin the rotor 3 about the spin axis s. The spin motor comprises a motor rotor fixed to the rotor axle 36 and a motor stator fixed to the stator 2. The motor axle may be connected to the rotor axle with a flexible coupling.

Figure 2D:
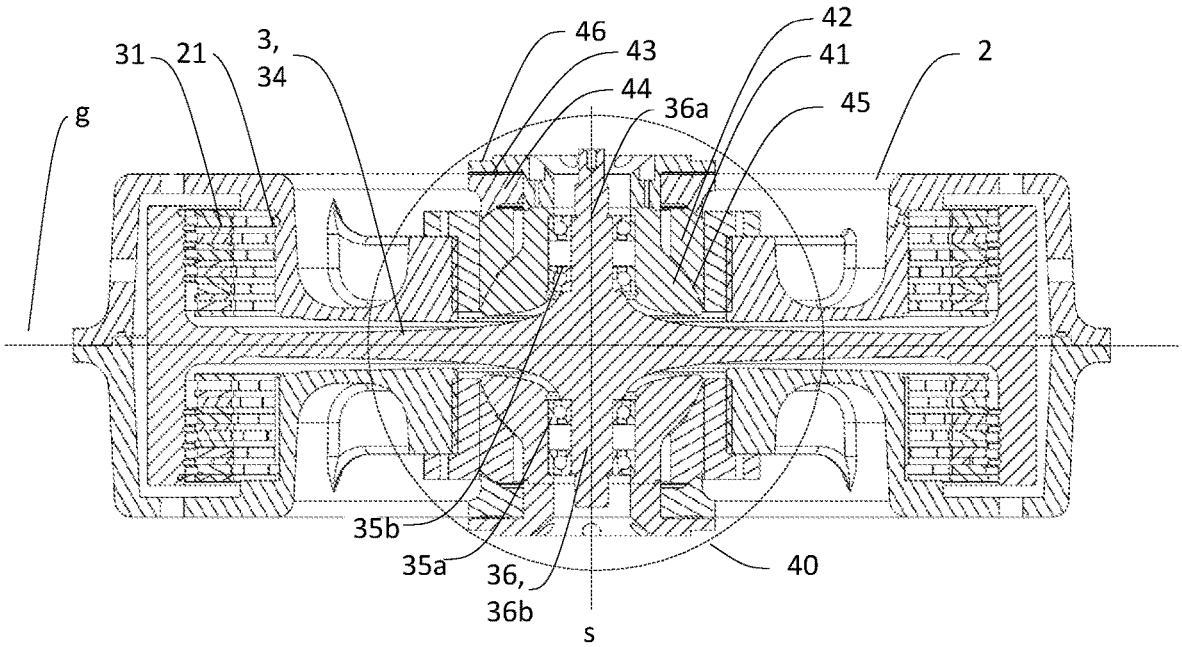
In FIG. 2*d* illustrates the gyro stabilizer according to an embodiment of the invention.

The embodiment illustrated in FIG. 2*d* is in most parts identical to the embodiment in FIGS. 2*b* and 2*c*, with the difference that the first and second bearings 35*a*, 35*b* are moved closer to the centre of the gyro stabilizer with regards to FIGS. 2*b* and 2*c*. In addition, the frictional interface 45 is also moved closer to the pivotal centre, where the gimbal axis and the spin axis intersect, in order to increase the radial component of the forces acting on the interface, and consequently reducing load on the first and second bearings. Further, the compressible spring 43 is here a plurality of smaller springs arranged about the spin axis s, between the first spring end support 46 and the first force distribution element 44.

Figure 3A:
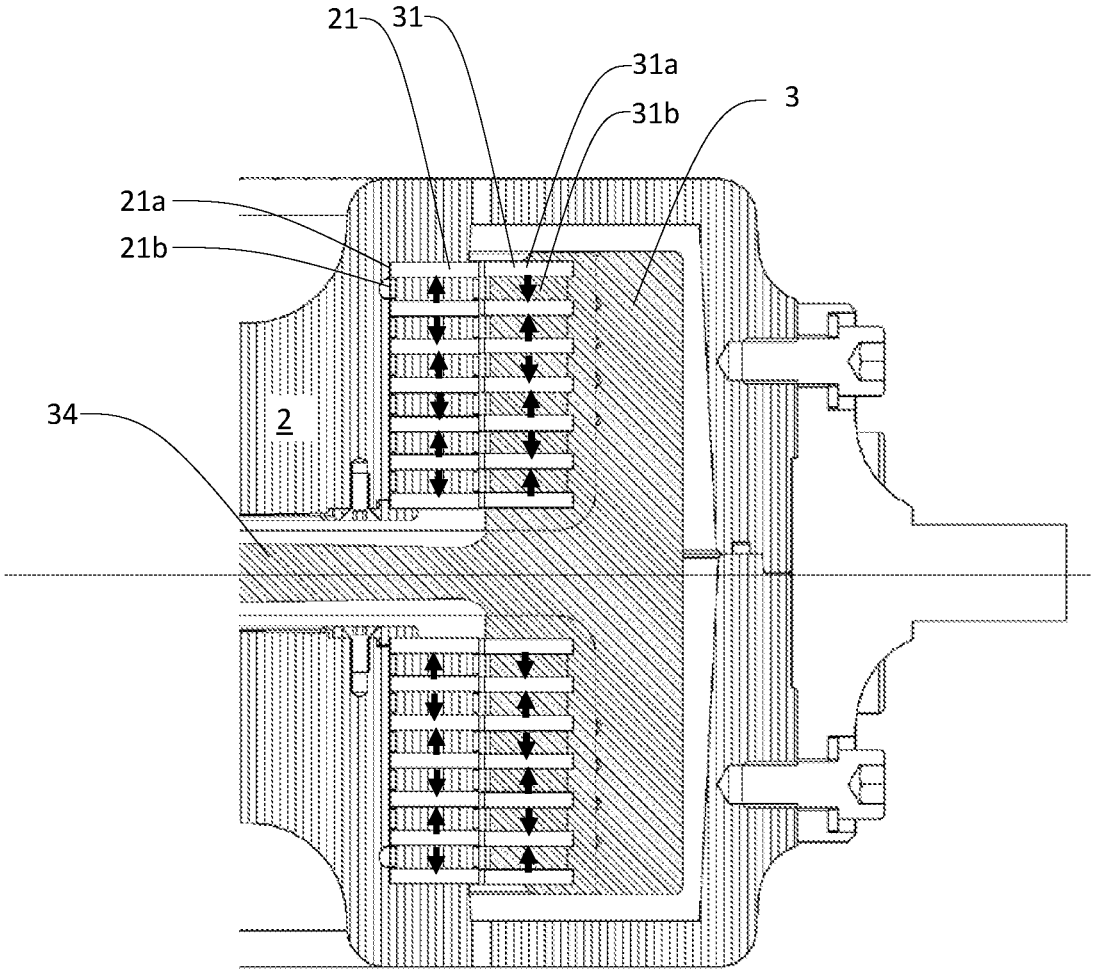
FIG. 3*a* illustrates the stator assembly 21 and the rotor assembly 31 in FIGS. 2*a*, 2*b* and 2*c* in more detail in a section view. The arrows indicate the direction of permanent magnets in the rotor and stator assemblies 21, 31.

FIG. 3*a* illustrates the stator assembly 21 and the rotor assembly 31 in FIG. 2*a* in more detail in a section view. The stator assembly 21 comprises a layered structure of stator magnetic field producing elements 21*a* and stator intermediate elements 21*b*, where the stator magnetic field producing elements 21*a* are permanent magnets and the stator intermediate elements 21*b* are made of steel.

The rotor assembly 31 comprises correspondingly a layered structure of rotor magnetic field producing elements 31*a* and rotor intermediate elements 31*b* in the same materials.

As can be seen from the drawings, the stator intermediate elements 21*b* are in line with the rotor intermediate elements 31*b* and the stator magnetic field producing elements 21*a* are in line with the rotor magnetic field producing elements 31*a*.

In the drawings the direction of the magnetic fields of the stator and rotor magnetic field producing elements 21*a*, 31*a* have been illustrated as arrows from south to north pole. More specifically, subsequent stator magnetic field producing elements 21*a* have alternating directions perpendicular to the radial direction. The same is true for the rotor magnetic field producing elements 31*a*. In addition, stator magnetic field producing elements 21*a* and rotor magnetic field producing elements 21*a* at the same level, i.e. interfacing magnetic elements, have opposite magnetic fields.

Figure 3B:
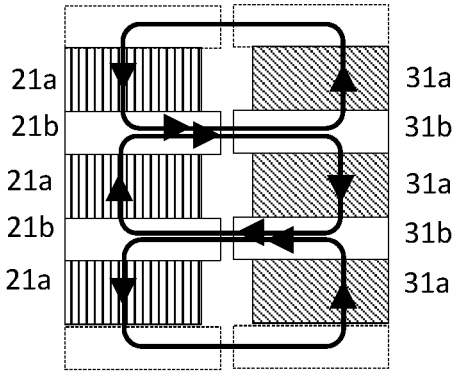
FIG. 3*b* illustrates schematically magnetic field lines resulting from the configuration of the stator and rotor assemblies 21, 31 in a detail view of FIG. 3*a*.

FIG. 3*b* illustrates schematically magnetic field lines resulting from the configuration of the stator and rotor assemblies 21, 31. As seen the stator and rotor magnetic field producing elements 21*a*, 31*a* above and below the intermediate elements 21*b*, 31*b* all contribute to the magnetic fields in the intermediate elements 21*b*, 31*b* in the radial direction.

As can be seen, the direction of the magnetic field lines in the radial direction alternates for subsequent levels of intermediate elements 21*b*, 31*b*. In this section, as well as in other sections around the circumference of the interface between the stator and rotor assemblies 21, 31, similar magnetic fields are set up, and the rotor 3 is held steadily in balance in a centred position.

However, for a magnetic gyro stabilizer to function properly. i.e., precess, the rotor must be allowed to pivot with regards to the stator.

The embodiment of the gyro stabilizer in FIG. 2*b* and FIG. 2*c*, is identical to the embodiment in FIG. 2*a*, except that the rotor base 40 has some additional features, improving the control of the pivoting movement. The shock absorbing features described for the embodiment in FIG. 2*a* are maintained.

In this embodiment the rotor base 40 comprises a first frictional interface 45 the shape of a spherical segment between the first rotational bearing 35*b* and the stator 2, wherein the frictional interface allows the rotor axle 36 to pivot with respect to the stator 2. This allows the rotor axle 36 to pivot in any direction with regards to the stator 2, provided a torque on the rotor is sufficient to overcome the frictional force of the frictional interface.

Inner and outer interfacing coupling elements 41, 42 constitute the frictional interface. As can be seen from the drawings, they have convex and concave shapes, respectively. The first inner coupling element 41 is fixed to the first bearing 35*a* and the first outer coupling element 42 is fixed to the stator 2. The outer coupling element is in this embodiment made in a compressible and elastic plastic material, while the inner coupling element is relatively less elastic.

As mentioned, the inner coupling element 41 is configured to move relative the outer coupling element 42 only when a torque on the rotor 3 relative the stator 2 increases above a torque threshold, where the threshold is determined by the force from first spring end support 46 compressing the first compression element 43 that again is compressing the outer coupling element 42. By carefully selecting the compression resulting in the desired threshold torque, a specific frictional number is achieved for the frictional interface. Due to the constant pressure of the disc spring this frictional number will stay the same after assembly of the gyro stabilizer and little or no maintenance is needed to maintain the function. Thus, a controlled damping of the rotor pivoting movement has been achieved without additional moving parts, while at the same time obtaining overload protection from external and internal impacts on the gyro stabilizer.

Maximum relative displacement of the rotor relative to the stator may be constrained e.g. by the available physical space. In FIG. 2*c*, when the rotor has pivoted to the maximum, about 1.3 degrees, the inner coupling element 42 abuts the outer coupling element 41 to prevent further movement in the same direction.

In the exemplary embodiments, various features and details are shown in combination. The fact that several features are described with respect to a particular example should not be construed as implying that those features by necessity have to be included together in all embodiments of the invention. Conversely, features that are described with reference to different embodiments should not be construed as mutually exclusive. As those with skill in the art will readily understand, embodiments that incorporate any subset of features described herein and that are not expressly interdependent have been contemplated by the inventor and are part of the intended disclosure. However, explicit description of all such embodiments would not contribute to the understanding of the principles of the invention, and consequently some permutations of features have been omitted for the sake of simplicity or brevity.

The invention claimed is:

1. A gyro stabilizer comprising:

a stator;

a rotor with a rotor axle configured to rotate about a spin axis in a first direction; and a rotor base arranged between the stator and the rotor, wherein the rotor base is configured to allow the rotor axle to move with regards to the stator in a direction different from the first direction, wherein the rotor base is configured to allow a first end of the rotor axle to move laterally and/or axially with respect to the stator, wherein the first end is supported by a first rotational bearing fixed to the rotor axle, and wherein the rotor base comprises a compressible elastic element arranged compressed in lateral and longitudinal directions with respect to the rotor axle between the stator and the first rotational bearing.

2. The gyro stabilizer of claim 1, wherein the rotor base is configured to allow the rotor axle to pivot with respect to the stator.

3. The gyro stabilizer of claim 1, wherein the rotor base comprises a first compression element configured to compress the elastic element.

4. The gyro stabilizer of claim 3, wherein the rotor axle is supported by a first rotational bearing fixed to the rotor axle, and the rotor base comprises a first frictional interface between the first rotational bearing and the stator, and wherein the first frictional interface allows the rotor axle to pivot with respect to the stator.

5. The gyro stabilizer of claim 4, wherein the first frictional interface has a shape of a spherical segment, allowing the rotor axle to pivot with regards to the stator.

6. The gyro stabilizer of claim 4, wherein the first frictional interface is arranged at least partly within 35 degrees from a plane perpendicular to the spin axis and in height with a gimbal axis.

7. The gyro stabilizer of claim 5, wherein the rotor base comprises first inner and outer coupling elements, wherein the first inner coupling element is fixed to the first rotational bearing and the first outer coupling element is the compressible elastic element, and is fixed to the stator, and wherein an interface between the first inner and outer coupling elements is the first frictional interface.

8. The gyro stabilizer of claim 7, wherein any of the first inner or outer coupling elements are compressible and elastic.

9. The gyro stabilizer of claim 8, wherein the inner coupling element is configured to move relative the outer coupling element only when a torque on the rotor relative the stator increases above a torque threshold.

10. The gyro stabilizer of claim 9, wherein the torque threshold is a function of the force from the first compression element on the outer coupling element.

11. The gyro stabilizer of claim 1, further comprising:

a rotor disc and the rotor base is symmetric about a plane parallel to the rotor disc.

12. The gyro stabilizer of claim 1, wherein the gyro stabilizer is magnetic, wherein the rotor and the stator comprise rotor and stator assemblies, respectively, and wherein the rotor assembly is arranged radially outside the stator assembly with respect to the spin axis.

13. The gyro stabilizer of claim 11, wherein the rotor/and or stator assembly comprises magnets stacked with alternating magnetic field directions in the direction of the spin axis.

14. A gyro stabilizer comprising:

a stator;

a rotor with a rotor axle configured to rotate about a spin axis in a first direction; and a rotor base arranged between the stator and the rotor, wherein the rotor base is configured to allow the rotor axle to move with regards to the stator in a direction different from the first direction, wherein the rotor base is configured to allow the rotor axle to pivot with respect to the stator, wherein a first end of the rotor axle is supported by a first rotational bearing fixed to the rotor axle, and wherein the rotor base comprises a compressible elastic element arranged compressed in lateral and longitudinal directions with respect to the rotor axle between the stator and the first rotational bearing.

15. The gyro stabilizer of claim 14, wherein the rotor axle is supported by a first rotational bearing fixed to the rotor axle, and the rotor base comprises a first frictional interface between the first rotational bearing and the stator, and wherein the first frictional interface allows the rotor axle to pivot with respect to the stator.

* * * * *